US010535953B2

(12) United States Patent
Kondo

(10) Patent No.: US 10,535,953 B2
(45) Date of Patent: Jan. 14, 2020

(54) CONNECTOR AND CONNECTOR MOUNTING STRUCTURE

(71) Applicant: Sumitomo Wiring Systems, Ltd., Yokkaichi, Mie (JP)

(72) Inventor: Tomoyuki Kondo, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/007,172

(22) Filed: Jun. 13, 2018

(65) Prior Publication Data

US 2018/0375257 A1 Dec. 27, 2018

(30) Foreign Application Priority Data

Jun. 27, 2017 (JP) ..... 2017-125405

(51) Int. Cl.
*H01R 13/631* (2006.01)
*H01R 13/625* (2006.01)

(52) U.S. Cl.
CPC ..... *H01R 13/6315* (2013.01); *H01R 13/625* (2013.01)

(58) Field of Classification Search
USPC ..... 439/252, 247, 366, 802, 242, 280, 336, 439/699.2, 753
See application file for complete search history.

(56) References Cited

U.S. PATENT DOCUMENTS 4,681,385 A * 7/1987 Kruger ..... H01R 24/76 439/186
5,419,717 A * 5/1995 Abendschein ..... G02B 6/3817 385/139
5,897,391 A * 4/1999 Takahashi ..... H01R 33/46 439/336
6,162,084 A * 12/2000 Chen ..... H01R 33/46 439/336
6,196,856 B1 * 3/2001 De Villeroche ... H01R 13/6315 439/248
6,325,668 B1 * 12/2001 Sato ..... H01R 33/9655 439/587
D457,496 S * 5/2002 Ko ..... D13/133
6,394,829 B1 * 5/2002 Patterson ..... H01R 13/6315 439/252
6,830,469 B1 * 12/2004 Doyle ..... H01R 13/6273 439/247

(Continued)

FOREIGN PATENT DOCUMENTS

JP 2016-58137 4/2016

*Primary Examiner* — Harshad C Patel
(74) *Attorney, Agent, or Firm* — Gerald E. Hespos; Michael J. Porco; Matthew T. Hespos

(57) ABSTRACT

A connector (10) includes a connector pin portion to be electrically connected to a case (R), a tubular portion (11) for accommodating the connector pin portion to face a mating member, and first and second bracket holding portions (21, 22) extending from an end part of the tubular portion (11) opposite to a side facing the connector pin portion and to be engaged with a bracket (30). Each of the first and second bracket holding portions (21, 22) includes insertion grooves (23, 24) through which the bracket (30) is insertable, and two bracket holding portions are provided on a lower surface (11*a*) of the tubular portion (11), which is the end part opposite to the side facing the connector pin portion.

5 Claims, 13 Drawing Sheets

(56) References Cited

U.S. PATENT DOCUMENTS

| | | | | |
|---|---|---|---|---|
| 7,892,001 | B2 * | 2/2011 | Hanyu | H01R 23/68<br>439/247 |
| 2009/0137143 | A1 * | 5/2009 | Takanashi | H01R 13/6315<br>439/374 |
| 2012/0135621 | A1 * | 5/2012 | Hayauchi | H01R 13/6275<br>439/247 |
| 2016/0071630 | A1 | 3/2016 | Sugino | |

* cited by examiner

CONNECTOR AND CONNECTOR MOUNTING STRUCTURE

BACKGROUND

Field of the Invention

The invention relates to a connector and a connector mounting structure.

Description of the Related Art

Conventionally, an electrical component including a connector and a supporting member for supporting this connector and configured such that the connector is mounted at a predetermined mounting position of a mating member by assembling the electrical component with a mating side is, for example, known as an electrical component used in an automatic transmission or the like of an automotive vehicle (see, for example Japanese Unexamined Patent Publication No. 2016-58137).

The connector of Japanese Unexamined Patent Publication No. 2016-58137includes a connecting portion to be electrically connected to the mating member, a tubular portion for accommodating the connecting portion to face the mating member and one engaging portion extending from an end part of the tubular portion opposite to a side facing the connecting portion and to be engaged with the supporting member. The one engaging portion is provided near a radially outer side of the tubular portion on the end part of the tubular portion and provided with an insertion hole through which the supporting member (locking piece) is insertable. Further, the supporting member restricts loose movements of the connector by the locking piece inserted through the insertion hole until immediately before the connector is mounted at the predetermined mounting position, but enables loose movements of the connector while the connector is being mounted at the predetermined mounting position by being assembled with the supporting member.

In the connector mounting structure as described above, the supporting member is loosely movably supported by one engaging portion, but it is desired to stabilize an alignment by stabilizing a configuration for loosely movably supporting the supporting member.

The invention was developed to solve the above problem and aims to provide a connector and a connector mounting structure designed to stabilize an alignment.

SUMMARY

A connector for solving the above problem includes a connecting portion to be connected electrically to a mating member. A tubular portion accommodates the connecting portion and faces the mating member. Engaging portions extend from an end part of the tubular portion opposite to a side facing the connecting portion and are configured to engage a supporting member in a state where loose movements are allowed. The engaging portion includes an insertion groove through which the supporting member is insertable. A plurality of the engaging portions are provided on the end part of the tubular portion opposite to the side facing the connecting portion.

According to this configuration, the engaging portions that extend from the end part of the tubular portion opposite to the side facing the connecting portion engage with the supporting member. By providing the engaging portions in this way, the connector is supported loosely movably by the supporting member at plural positions to achieve a stabilized alignment of the connector.

Two of the engaging portions may be at diametrically opposite positions of the tubular portion. According to this configuration, stable support is possible when the supporting member is inserted into and engaged with the insertion grooves.

Lower end surfaces of the engaging portions may be flush with each other. According to this configuration, stable placement is possible on the lower end surface sides of the engaging portions of the connector.

One of the engaging portions may be at a position deviated from the tubular portion. According to this configuration, a distance between the engaging portions is made longer by proving one of the engaging portions at the position deviated from the tubular portion to achieve more stable support.

A harness holding portion for holding a harness may be integral with one of the engaging portions. According to this configuration, the harness can be held without increasing the number of components by integrally providing the harness holding portion to one of the engaging portions.

A connector mounting structure for solving the above problem is configured for mounting a connector at a mounting position of a mating member by assembling an electrical component including the connector and a supporting member for loosely movably supporting the connector with the mating member. The supporting member allows loose movements of the connector in a state where the connector is assembled. The connector includes a connecting portion to be electrically connected to the mating member, a tubular portion for accommodating the connecting portion to face the mating member, and engaging portions extending from an end part of the tubular portion opposite to a side facing the connecting portion and to be engaged with the supporting member in a state where loose movements are allowed. The engaging portion includes an insertion groove through which the supporting member is insertable and a plurality of the engaging portions are provided on the end part of the tubular portion opposite to the side facing the connecting portion.

According to this configuration, the engaging portions extending from the end part of the tubular portion opposite to the side facing the connecting portion and to be engaged with the supporting member are provided on this end part. By providing the engaging portions in this way, the connector is loosely movably supported by (engaged with) the supporting member at a plurality of positions, wherefore a configuration for loosely movably supporting the connector by the supporting member can be stabilized to stabilize an alignment.

According to the connector and the connector mounting structure of the present invention, an alignment is stabilized.

DETAILED DESCRIPTION

One embodiment of an electrical component including a connector is described with reference to FIGS. 1 to 13. Note that a part of a configuration may be shown in an exaggerated or simplified manner for the convenience of description in each figure. Further, a size ratio of each part may be different from an actual one.

As shown in FIGS. 1 to 4, an electrical component 1 disposed in a case (not shown) of an automatic transmission of an automotive vehicle and to be electrically connected to an external circuit via a case R serving as a mating member is shown in this embodiment. Note that, in the following description, a width direction is based on a direction of an arrow X of FIG. 1, a front-rear direction is based on a direction of an arrow Y of FIG. 1 with a shown right-lower side defined as a front side, and a vertical direction is based on a direction of an arrow Z of FIG. 1.

Figure 1:
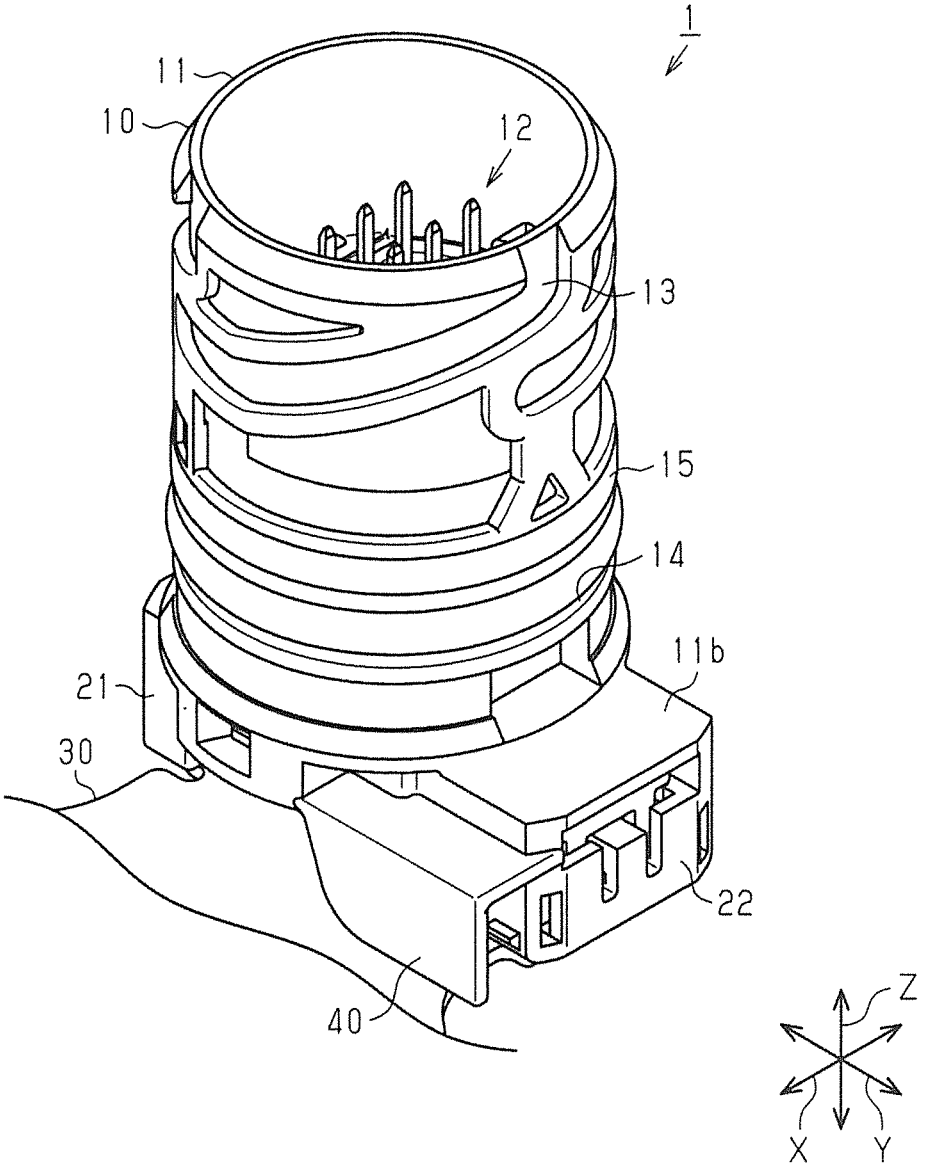
FIG. 1 is a perspective view showing a state where a connector and a bracket of an embodiment are assembled.
Figure 2:
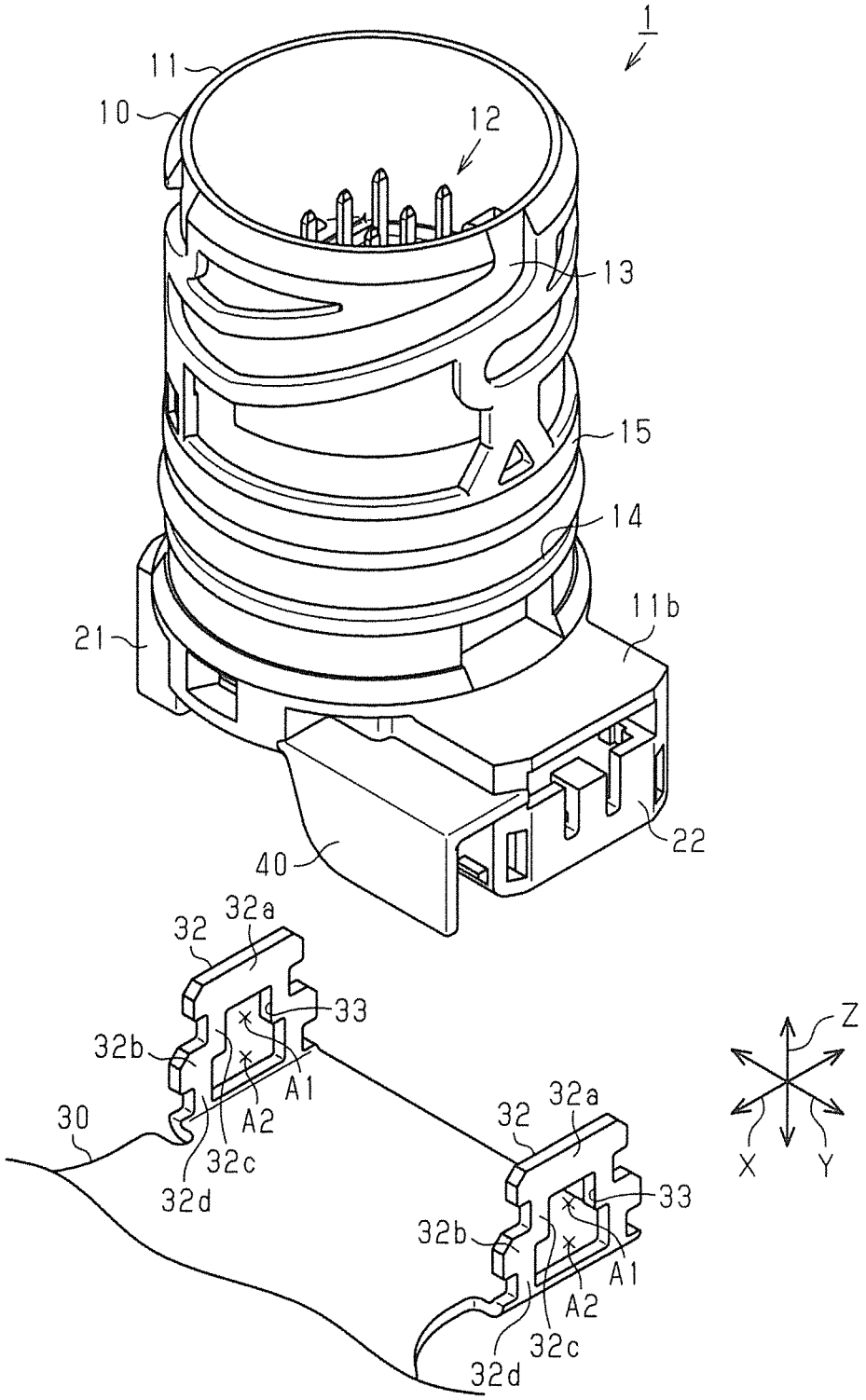
FIG. 2 is a perspective view showing a state where the connector and the bracket of the embodiment are removed.

The case R includes a plate R1 made of synthetic resin. The plate R1 is provided with an external circuit connecting portion (not shown) to be connected to the external circuit and an electrical component connecting portion (not shown) to be connected to the electrical component 1. As shown in FIG. 1, this electrical component connecting portion is provided inside a mounting hole (example of a "mounting position" of the present invention) R2 open in one surface (lower surface) of the plate R1. Further, a guiding surface R3 having an inclined surface for gradually widening an opening toward an outer side (shown downward direction Z) is circumferentially provided on an opening edge of the mounting hole R2. Note that a connector 10 to be described later is insertable (mountable) into the mounting hole R2.

As shown in FIGS. 1, 2, 7 and 8, the electrical component 1 includes the connector 10 and a bracket 30 serving as a supporting member mounted on a lower end part of the connector 10. The bracket 30 supports the connector 10 to allow loose movements of the connector 10 in a state assembled with the connector 10.

The bracket 30 is formed by stamping and bending a metal plate. The bracket 30 includes a base bottom portion 31 extending in the front-rear direction and a pair of mounting pieces 32 rising from the rear and front edges of the base bottom portion 31.

Each mounting piece 32 includes a first wide portion 32*a* formed by widening an upper end part of the mounting piece 32 and a second wide portion 32*b* formed below (on the side of the base bottom portion 31) the first wide portion 32*a*.

The second wide portion 32*b* is set slightly wider than the first wide portion 32*a*.

Further, in the mounting piece 32, a part between the lower end of the first wide portion 32*a* and the upper end of the second wide portion 32*b* is formed into a first narrow portion 32*c* narrower than the first wide portion 32*a*, and a part connected to the lower end of the second wide portion 32*b* is formed into a second narrow portion 32*d* narrower than the second narrow portion 32*b*.

Further, a through hole 33 penetrating in a plate thickness direction (front-rear direction) is provided in the mounting piece 32. The through hole 33 is formed such that a first range A1 from the first narrow portion 32*c* to an intermediate part of the second wide portion 32*b* and a second range A2 from the intermediate part of the second wide portion 32*b* to the second narrow portion 32*d* have different widths. More specifically, the second range A2 is formed wider than the first range A1 of the through hole 33. A vertical dimension of the first range A1 of the through hole 33 is set substantially equal to that of the second range A2.

The connector 10 includes a tubular portion 1 in the form of a cylindrical tube open upward and a connector pin portion 12 serving as a connecting portion provided to project upward from a back end (lower end) inside the tubular portion 11.

A cam groove 13 is spirally formed in an upper end part of the outer peripheral surface of the tubular portion 11. On the other hand, the electrical component connecting portion includes a rotary member (not shown) and a cam pin (not shown) provided on this rotary member is insertable into the cam groove 13.

Thus, by rotating the rotary member after the connector 10 is inserted into the mounting hole R2 and the cam pin is inserted into the cam groove 13, the connector 10 is pulled to the back (upper side) of the mounting hole R2. When the connector 10 is inserted to a proper position inside the mounting hole R2, the connector 10 is properly connected to the electrical component connecting portion.

A groove portion 14 in the form of a recess recessed radially inwardly is continuously provided in a circumferential direction below the cam groove 13 in the outer peripheral surface of the tubular portion 11. A rubber ring 15 is mounted in this groove portion 14. When the tubular portion 11 is inserted into the mounting hole R2, the rubber ring 15 is held in close contact over the entire circumference between the inner peripheral surface of the mounting hole R2 and a peripheral surface constituting the groove portion 14. Thus, the entrance of water into the inside of the mounting hole R1 from outside is restricted.

First and second bracket holding portions 21, 22 are respectively provided on a lower surface 11*a* of the tubular portion 11.

The first bracket holding portion 21 is formed to hang down from the lower surface 11*a* on a rear end side of the tubular portion 11. Specifically, the first bracket holding portion 21 is formed to overlap with the tubular portion 11 in the vertical direction.

The second bracket holding portion 22 is formed to hang down from an extending portion 11*b* extending laterally (forward) from the lower surface 11*a* of the tubular portion 11. Specifically, the second bracket holding portion 22 is formed at a position not overlapping with the tubular portion 11 in the vertical direction (position deviated from the tubular portion 11). Further, the second bracket holding portion 22 is provided at a position opposite to the first bracket holding portion 21 by 180° in the circumferential direction of the tubular portion 11.

Lower end surfaces 21*a*, 22*b* of the first and second bracket holding portions 21, 22 are flush each other.

Each of the first and second bracket holding portions 21, 22 includes a first insertion groove 23 into which the first wide portion 32*a* of the mounting piece 32 is inserted and a second insertion groove 24 into which the second wide portion 32*b* of the mounting piece 32 is inserted. The first insertion groove 23 is arranged above the second insertion groove 24. Specifically, the first insertion groove 23 is provided closer to the lower surface 11*a* of the tubular portion 11 than the second insertion groove 24.

Further, each of the first and second bracket holding portions 21, 22 includes protection walls 25 respectively arranged before and behind each insertion groove 23, 24 to restrict the damage of the insertion grooves 23, 24 by an external impact.

Each first insertion groove 23 is formed to be able to sandwich both side parts of the first wide portion 32*a* in both the front-rear direction and the width direction. Specifically, the first insertion groove 23 includes a pair of groove portions having a substantially gate-shaped cross-section, X-direction restricting walls 23*a* on a back surface side constituting these groove portions are facing each other and the both groove portions are disposed at a predetermined distance in the width direction. An interval between the X-direction restricting walls 23*a* is substantially equal to or slightly larger than the width of the first wide portion 32*a* and wider than the width of the first narrow portion 32*c*. Further, a Y-direction restricting wall 23*b* on a front surface side constituting the groove portion is facing a Y-direction restricting wall 23*c* on a rear surface side, and an interval between the Y-direction restricting walls 23*b*, 23*c* is substantially equal to or slightly larger than a plate thickness of the first wide portion 32*a*.

Figure 12:
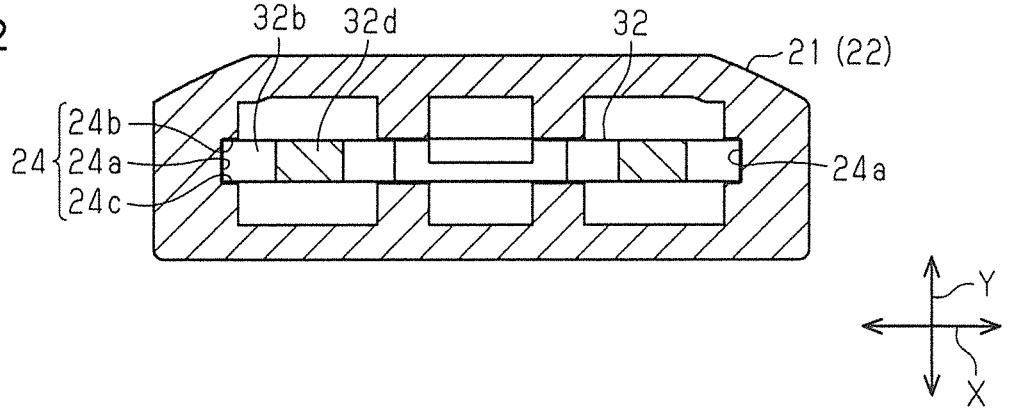
FIG. 12 is a section showing the state where the connector and the bracket of the embodiment are assembled.

The second insertion groove 24 is formed to be able to sandwich both side edge parts of the second wide portion 32*b* in both the front-rear direction and the width direction. Specifically, the second insertion groove 24 includes a pair of groove portions having a substantially gate-shaped cross-section, X-direction restricting walls 24*a* on a back surface side constituting these groove portions are facing each other and the both groove portions are disposed at a predetermined distance in the width direction. An interval between the X-direction restricting walls 24*a* is substantially equal to or slightly larger than the width of the second wide portion 32*b* as shown in FIG. 12 and wider than the width of the second narrow portion 32*d* as shown in FIG. 12. Further, a Y-direction restricting wall 24*b* on a front surface side constituting the groove portion is facing a Y-direction restricting wall 24*c* on a rear surface side, and an interval between the Y-direction restricting walls 24*b*, 24*c* is substantially equal to or slightly larger than a plate thickness of the second wide portion 32*b*.

In each of the first and second bracket holding portions 21, 22, a first accommodation space 26*a* capable of accommodating the first wide portion 32*a* is formed between the upper end of the first insertion groove 23 and the lower surface 11*a* of the tubular portion 11. The first accommodation space 26*a* is set wider than the width of the first wide portion 32*a* and a vertical dimension thereof is set larger than that of the first wide portion 32*a*. Further, the first wide portion 32*a* accommodated inside the first accommodation space 26*a* is freely movable in the front-rear direction between the both protection walls 25.

Note that the first accommodation space 26*a* is facing forward through an opening extending in the width direction in a cut portion 25*a* formed by making a substantially T-shaped cut in the protection wall 25. A locking piece 27 deflectable in a plate thickness direction of the protection wall 25 (plate thickness direction of the mounting piece 32) is provided to project upward at a lower end of the vertically extending opening in this cut portion 25*a*.

In each of the first and second bracket holding portions 21, 22, a second accommodation space 26*b* capable of accommodating the second wide portion 32*b* is formed between the lower end of the first insertion groove 23 and the upper end of the second insertion groove 24. The second accommodation space 26*b* is set wider than the width of the second wide portion 32*b* and a vertical dimension thereof is set slightly larger than that of the second wide portion 32*b*. Further, the second wide portion 32*b* accommodated inside the second accommodation space 26*b* is freely movable in the front-rear direction between the both protection walls 25.

In the connector 10 of this example, a harness holding portion 40 is provided on the side of the second bracket holding portion 22. The harness holding portion 40 is in the form of a groove open on a lower side, which is one side in the vertical direction. Two holding pieces 42 respectively extending from side walls 41 facing each other are provided near an opening 40*a* on the lower side of the harness holding portion 40. The holding pieces 42 narrow an opening amount of the opening 40*a* to suppress the detachment of a harness through the opening 40*a*. Further, each holding piece 42 includes a tapered portion on the side of the opening 40*a*. The respective tapered portions are formed into such inclined surfaces as to be more separated from each other toward the opening 40*a*. This makes it easier to insert (accommodate) the harness from the side of the opening 40*a*.

As described above, the connector 10 is vertically movable between a restricted position and an allowed position with respect to the bracket 30 and located at the restricted position to have loose movements restricted until immediately before being mounted into the mounting hole R2, but located at the allowed position while being mounted into the mounting hole R2.

Figure 3:
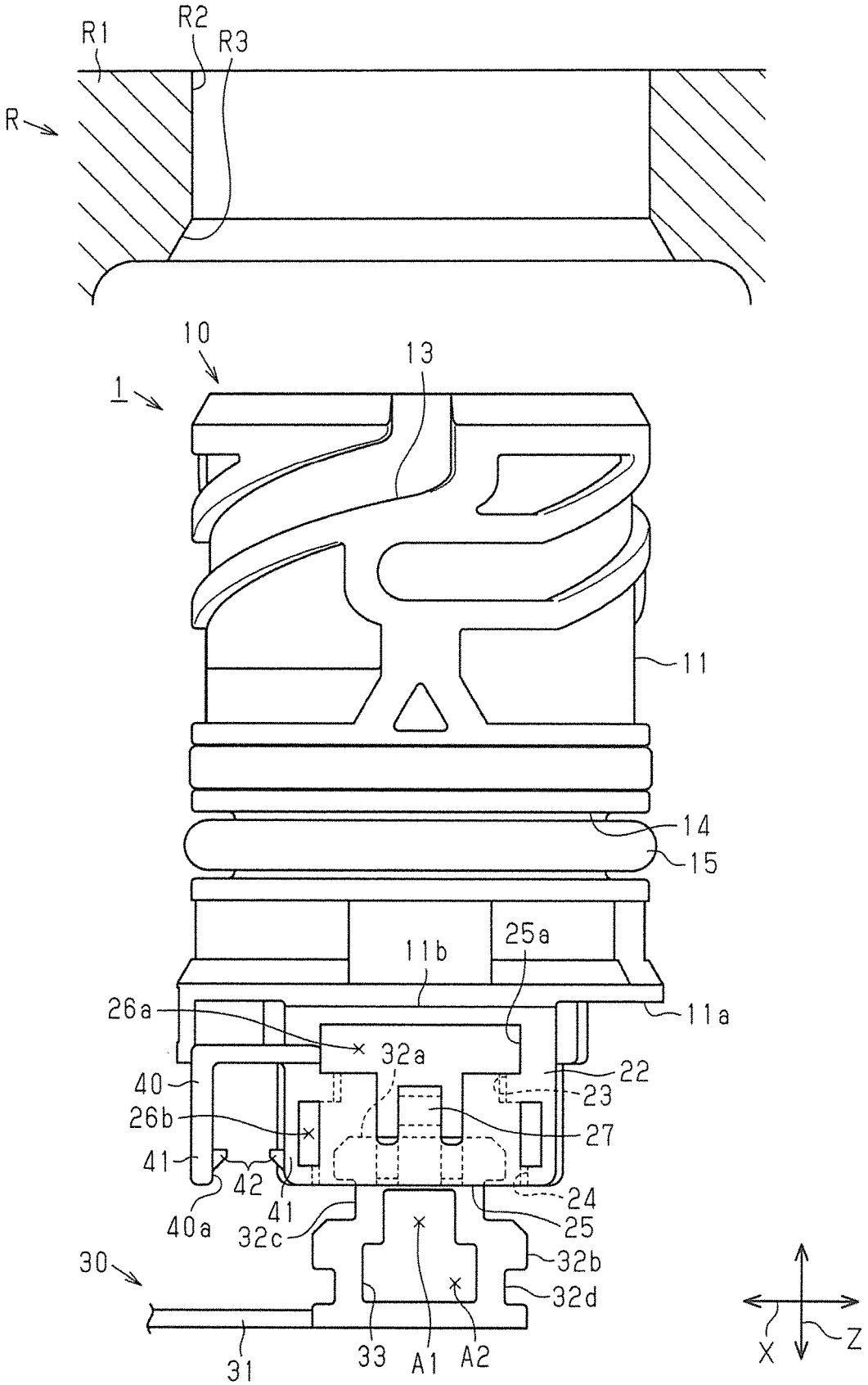
FIG. 3 is a front view showing a state while the connector and the bracket of the embodiment are being assembled.
Figure 4:
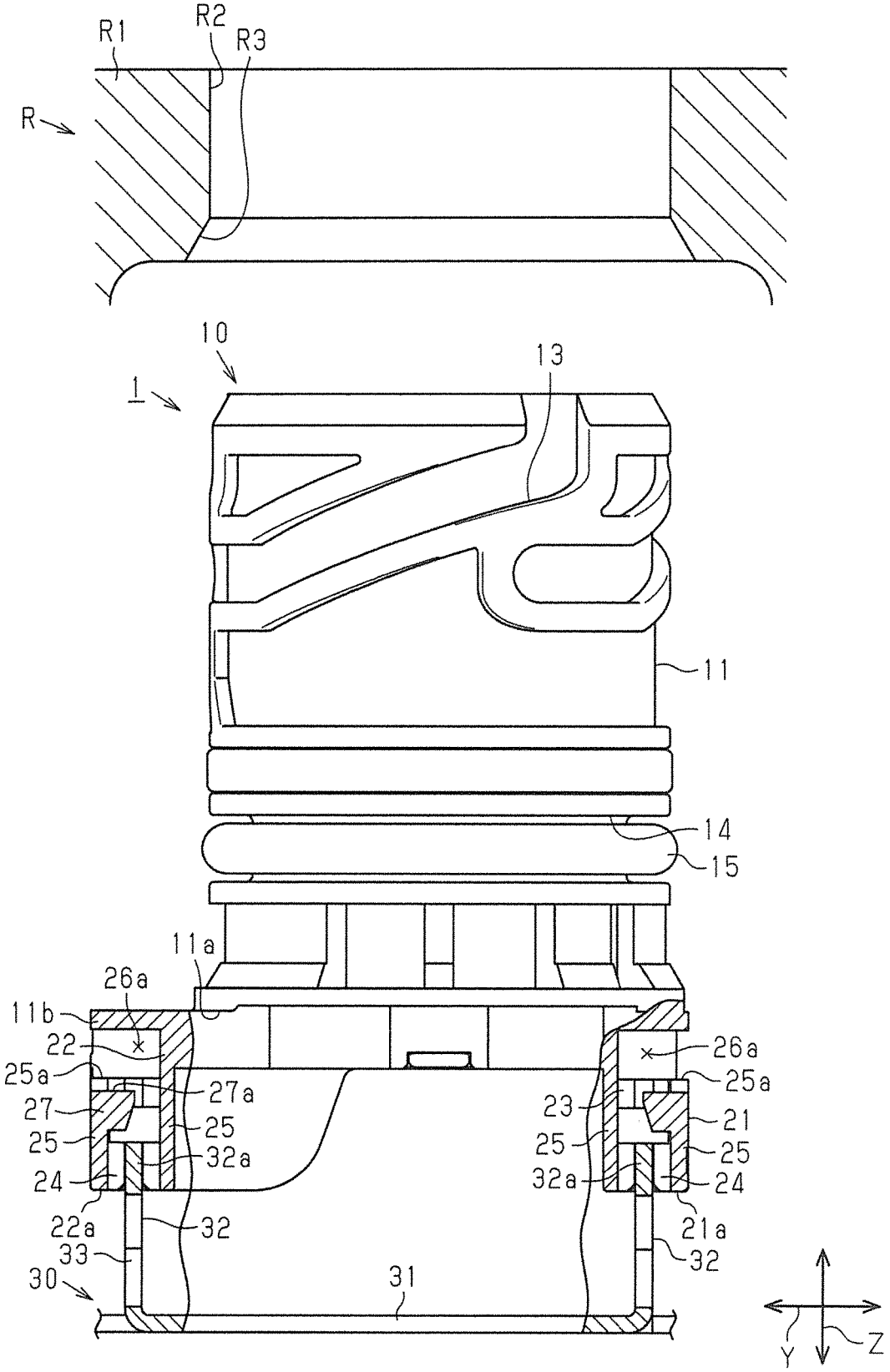
FIG. 4 is a side view partly in section showing the state while the connector and the bracket of the embodiment are being assembled.

When the connector 10 is at the restricted position, upper end parts of the first wide portions 32*a* are located in lower end parts of the second insertion grooves 24 as shown in FIG. 3. Thus, a movement of the connector 10 in the front-rear direction is restricted.

Figure 5:
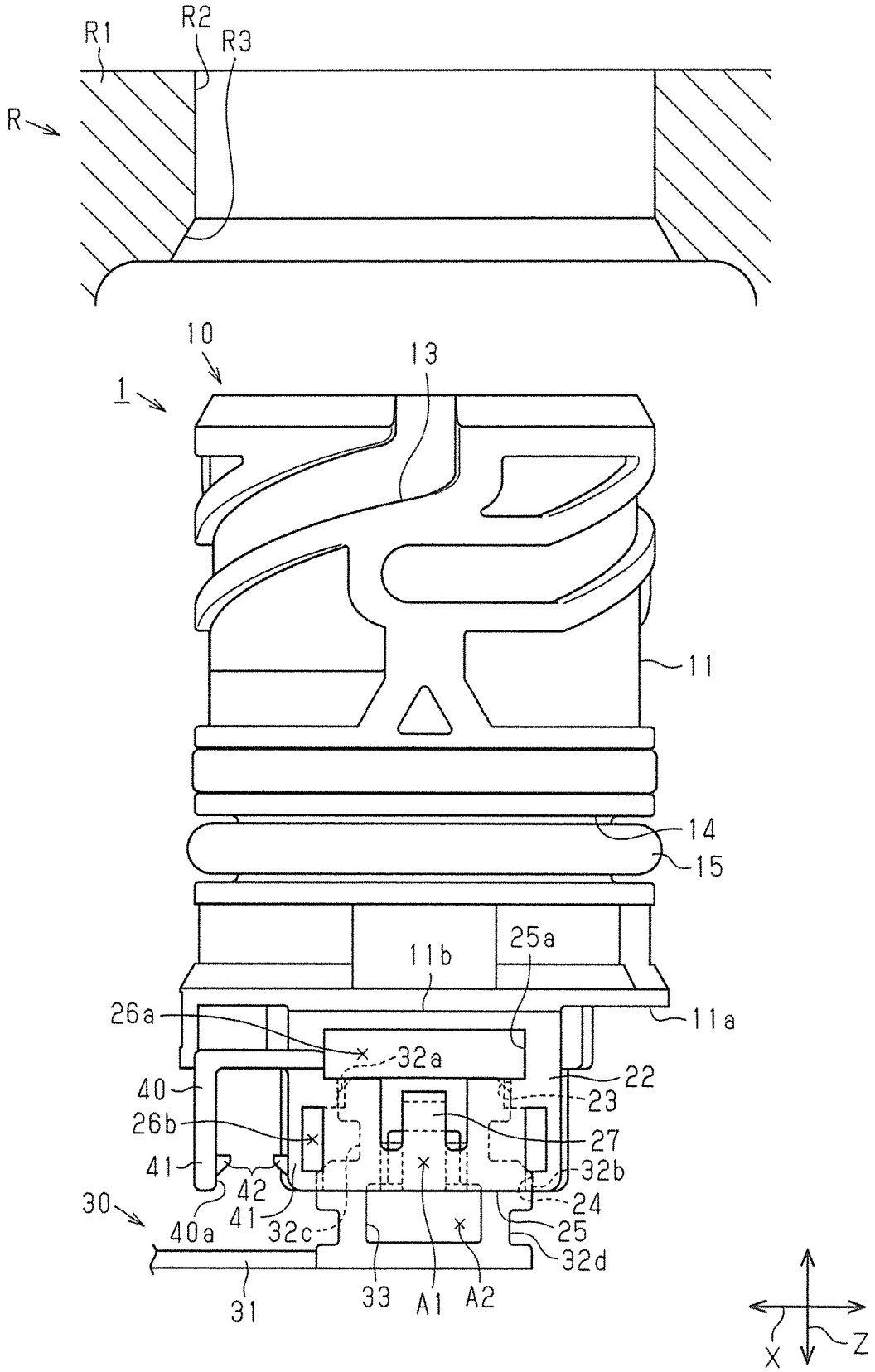
FIG. 5 is a front view showing the state while the connector and the bracket of the embodiment are being assembled.
Figure 6:
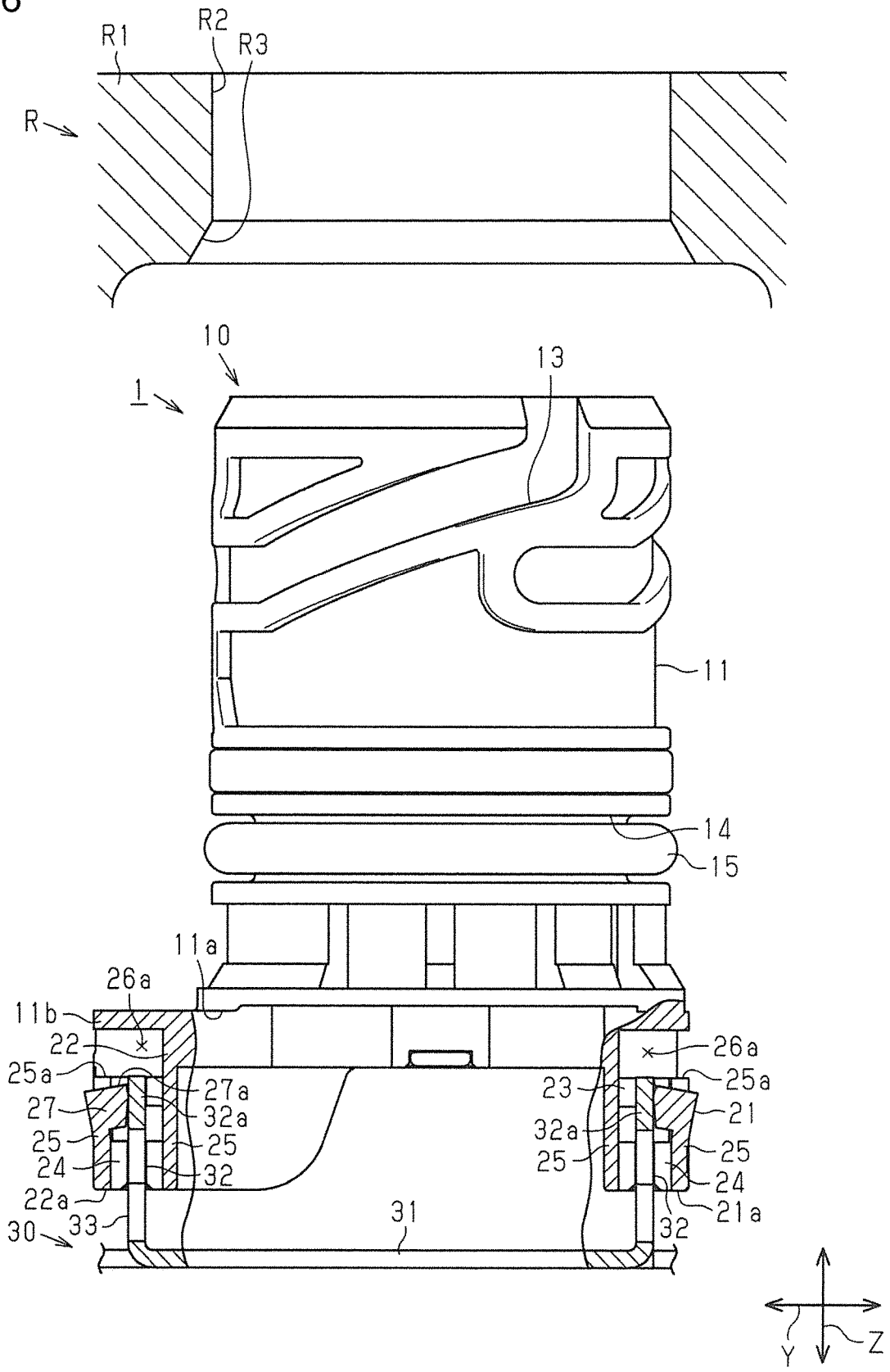
FIG. 6 is a side view partly in section showing the state while the connector and the bracket of the embodiment are being assembled.

While the connector 10 is moving toward the allowed portion, the first wide portions 32*a* are inserted into the first insertion grooves 23 and the second wide portions 32*b* are inserted into the second insertion grooves 24 as shown in FIG. 5. Thus, movements of the connector 10 in both the width direction and the front-rear direction are restricted. At this time, as shown in FIG. 6, upper end locking surfaces 27*a* of the locking pieces 27 move onto the first wide portions 32*a* in the mounting pieces 32 while the locking pieces 27 are deflected and deformed. When the connector 10 reaches the allowed portion, the locking pieces 27 return and the upper end locking surfaces 27*a* are fit into the through holes 33 as shown in FIG. 8.

Figure 7:
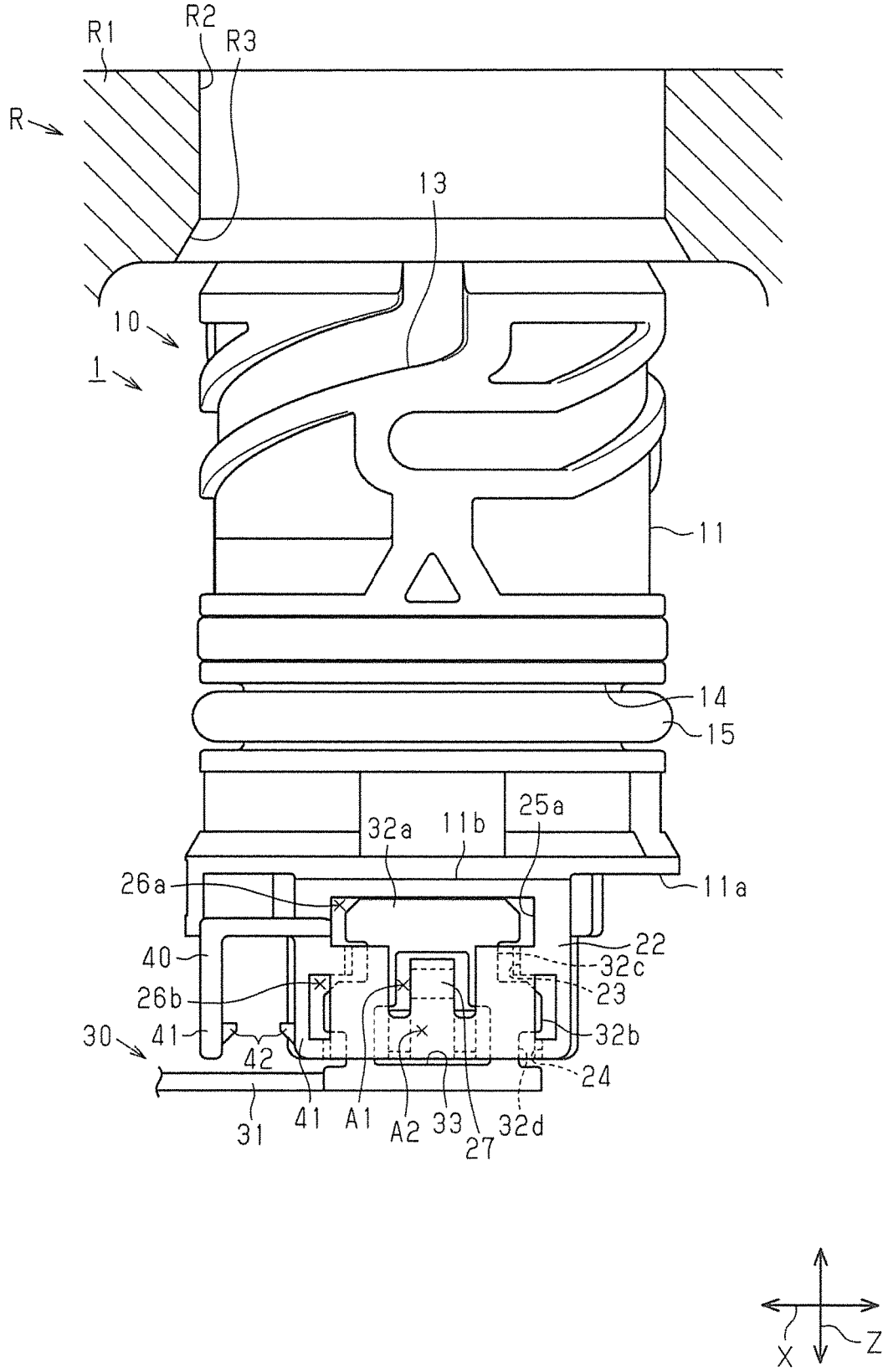
FIG. 7 is a front view showing the state where the connector and the bracket of the embodiment are assembled.
Figure 13:
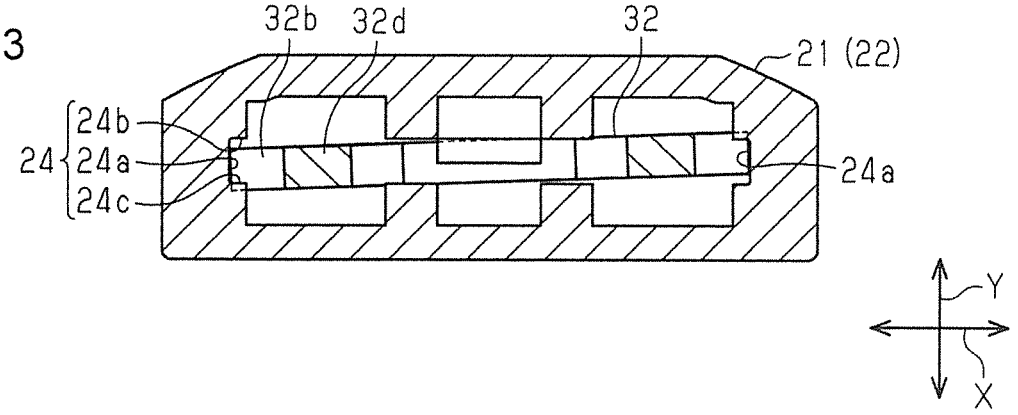
FIG. 13 is a section showing a state where the assembled connector and bracket of the embodiment are inclined in the width direction and the front-rear direction.

When the connector 10 is at the allowed portion, the first wide portions 32*a* are accommodated in the first accommodation spaces 26*a*, the first narrow portions 32*c* are arranged between the both groove portions of each first insertion groove 23, the second wide portions 32*b* are accommodated in the second accommodation spaces 26*b* and the second narrow portions 32*d* are arranged between the both groove portions of each second insertion groove 24 as shown in FIG. 7. Thus, the connector 10 is allowed to move in both the width direction and the front-rear direction as shown in FIGS. 9, 10 or 13.

Figure 8:
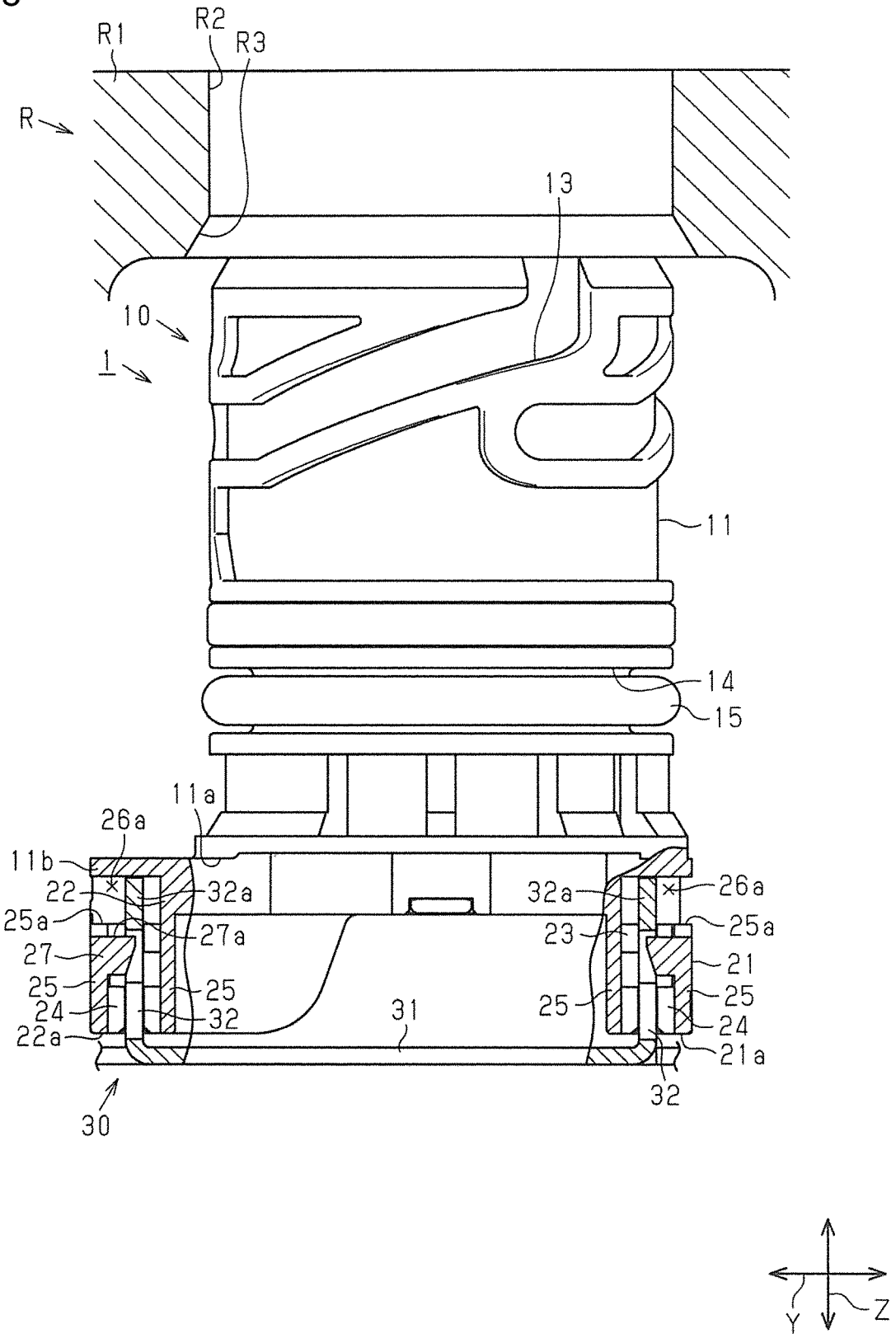
FIG. 8 is a side view partly in section showing the state where the connector and the bracket of the embodiment are assembled.

Since clearances are formed between the upper end locking surfaces 27*a* of the locking pieces 27 and upper sides of the inner peripheral surfaces of the through holes 33 in the vertical direction as shown in FIG. 8, the connector 10 is allowed to move upward by these clearances.

Figure 9:
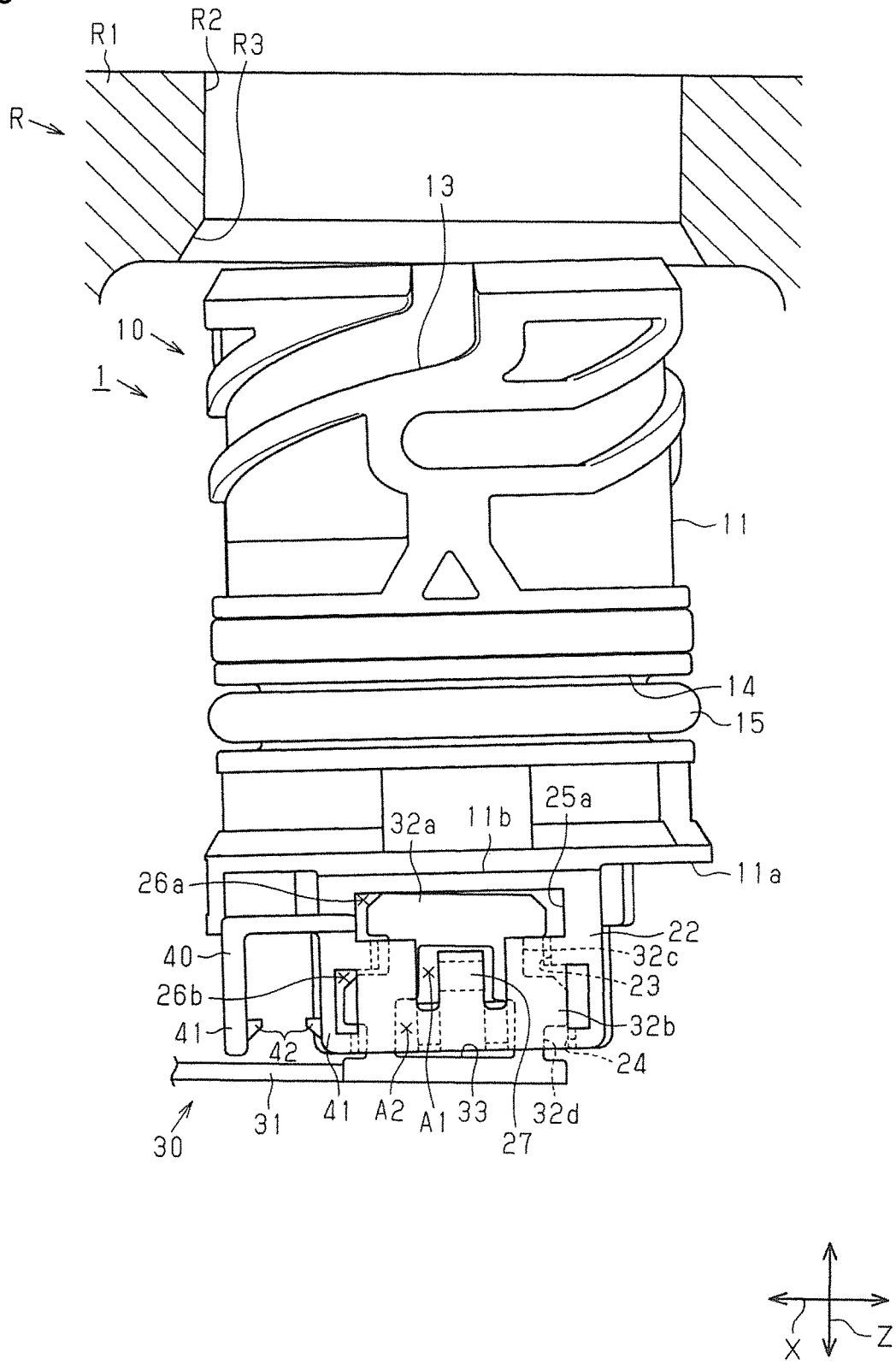
FIG. 9 is a front view showing a state where the assembled connector and bracket of the embodiment are inclined in a width direction and a vertical direction.
Figure 10:
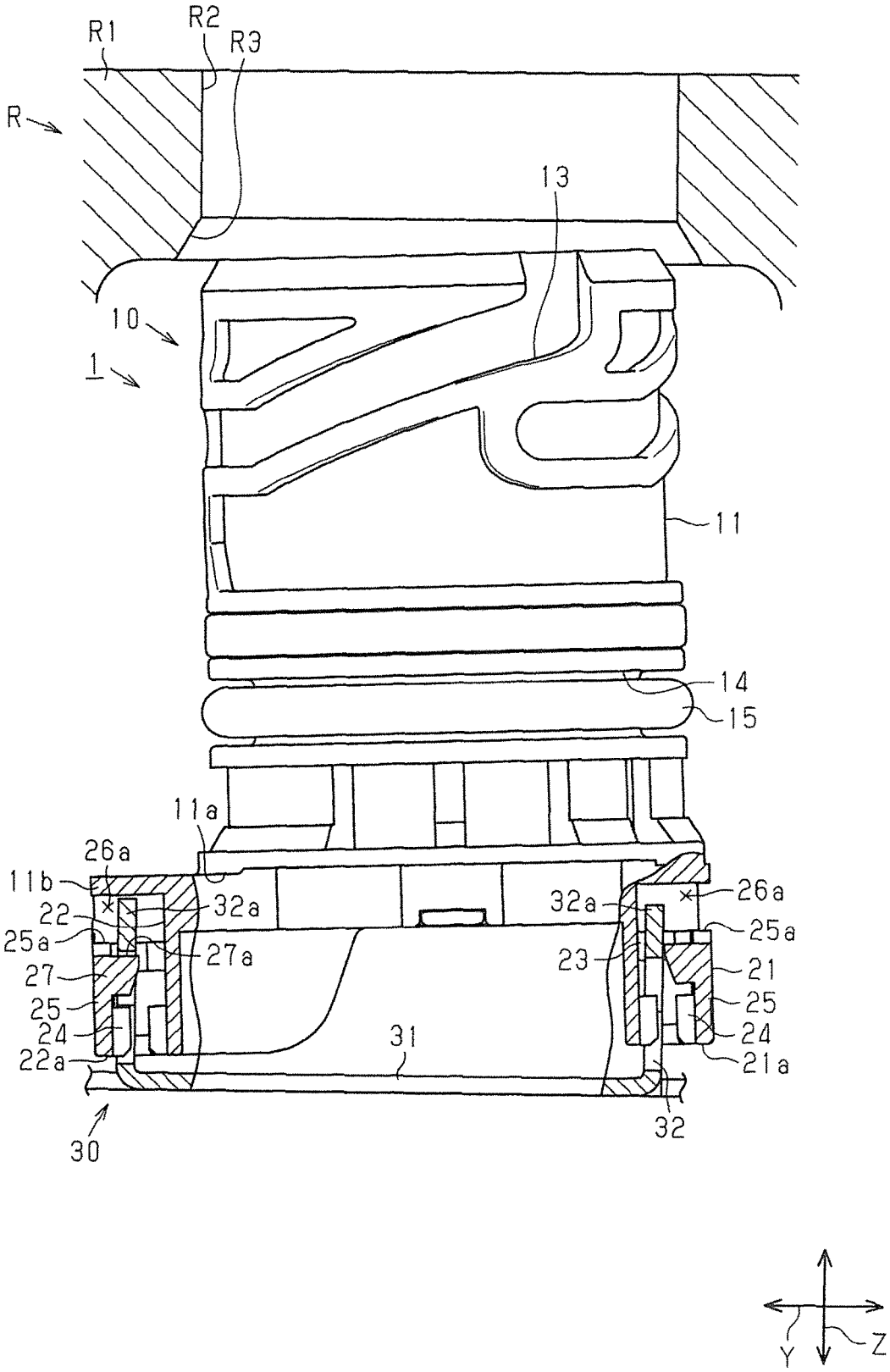
FIG. 10 is a side view partly in section showing a state where the assembled connector and bracket of the embodiment are inclined in a front-rear direction and the vertical direction.
Figure 11:
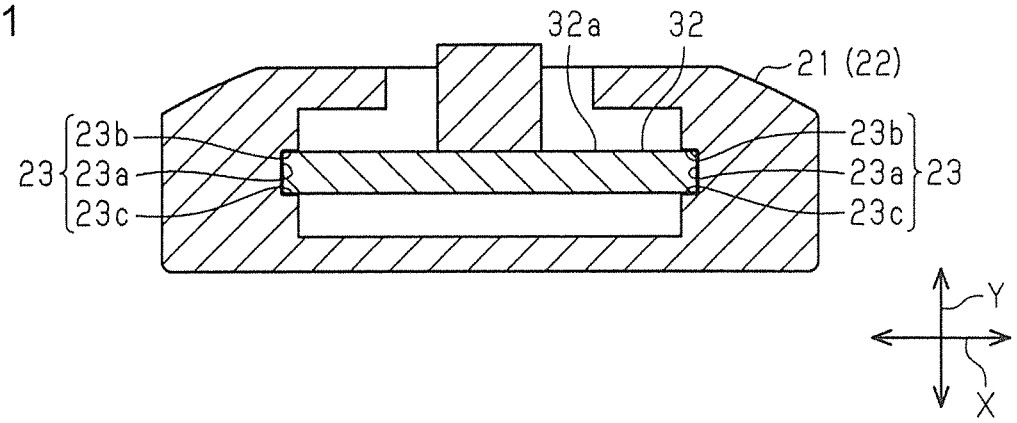
FIG. 11 is a section showing the state while the connector and the bracket of the embodiment are being assembled.

Since the connector 10 is loosely movably mounted on the bracket 30 as shown in FIGS. 7 and 8, the connector 10 is allowed to move in the width direction and the vertical direction as shown in FIG. 9 and allowed to move in the front-rear direction and the vertical direction as shown in FIG. 10.

Next, functions of this embodiment are described.

When the connector 10 is at the allowed portion (in an assembled state), the first wide portions 32*a* are accommodated in the first accommodation spaces 26*a*, the first narrow portions 32*c* are arranged between the both groove portions of each first insertion groove 23, the second wide portions 32*b* are accommodated in the second accommodation spaces 26*b* and the second narrow portions 32*d* are arranged between the both groove portions of each second insertion groove 24 as shown in FIG. 7. Thus, the connector 10 is allowed to move in both the width direction and the front-rear direction as shown in FIG. 9, 10 or 13.

Subsequently, the electrical component 1 is assembled with the case R, and the connector 10 can be inserted into the mounting hole R2, following an operation of bringing the connector 10 relatively closer to the mounting pieces 32. At this time, an assembling direction of the connector 10 may be inclined with respect to a proper assembling direction, but the connector 10 is loosely movably supported on the bracket 30. Thus, there is no possibility of pressing the connector 10 against the inner peripheral surface of the mounting hole R2 or the like and the connector 10 can be smoothly inserted. Specifically, since an assembling error in an operation of assembling the electrical component 1 with the case R can be absorbed, a smooth inserting operation of the connector 10 into the mounting hole R2 can be ensured.

As described above, in this embodiment, loose movements of the connector 10 are allowed while the connector 10 is being mounted into the mounting hole R2. Thus, there is no possibility of deviation of an axial position of the connector 10 from an axial center of the mounting hole R2. Therefore, the operation of mounting the connector 10 into the mounting hole R2 is facilitated.

Further, since a mounting direction of the connector 10 into the mounting hole R2 and an inserting direction of the connector 10 between the mounting pieces 32 coincide, the operation of mounting the connector 10 into the mounting hole R2 can be performed, following an operation of inserting each mounting piece 32 into the both insertion grooves 23, 24.

Further, since the connector 10 of this example is assembled with the bracket 30 by the two bracket holding portions 21, 22, the connector 10 can be stably supported by the bracket 30. In this way, an alignment is stabilized. Further, since a plurality of restricting portions structured differently from one holding portion (engaging portion) as before are not provided, an end part of the connector 10 on a side where the bracket holding portions 21, 22 are provided can be shortened by providing two identical bracket holding portions 21, 22.

Next, effects of this embodiment are described.

A plurality of the bracket holding portions 21, 22 extending from the end part (lower surface 11) of the tubular portion 11 opposite to the side facing the connector pin portion 12 and to be engaged with the bracket 30 are provided on this end part. By proving the plurality of bracket holding portions 21, 22 in this way, the connector 10 is loosely movably supported by (engaged with) the bracket 30 at a plurality of positions, wherefore a configuration for loosely movably supporting the connector 10 by the bracket 30 can be stabilized to stabilize an alignment.

Since two bracket holding portions 21, 22 are provided at opposite positions different by 180° in the circumferential direction of the tubular portion 11, stable support is possible when the bracket 30 is inserted into and engaged with the insertion grooves 23, 24.

Since the lower end surfaces 21*a*, 22*a* of the plurality of bracket holding portions 21, 22 are flush each other, stable placement is possible on the side of the lower end surfaces 21*a*, 22*a* of the bracket holding portions 21, 22 of the connector 10.

By proving one bracket holding portion 22, out of the bracket holding portions 21, 22, at the position deviated from the tubular portion 11, a distance between the bracket holding portions 21, 22 is made longer, wherefore stable support by the bracket 30 is possible.

By integrally providing the harness holding portion 40 to the bracket holding portion 22, the harness can be held without increasing the number of components.

The plurality of bracket holding portions 21, 22 extending from the end part (lower surface 11*a*) of the tubular portion 11 opposite to the side facing the connector pin portion 12 and to be engaged with the bracket 30 are provided on this end part. By providing the plurality of identical bracket holding portions 21, 22 in this way, a restricting portion differently structured than the bracket holding portions 21, 22 can be omitted. By shortening the end part of the connector 10 on the side where the bracket holding portions 21, 22 are provided, the entire connector 10 can be shortened.

Note that the above embodiment may be changed as follows.

Although two first and second bracket holding portions 21, 22 are provided in the above embodiment, the number of the bracket holding portions may be changed to three or more.

Although the first and second bracket holding portions 21, 22 are located at the opposite positions different by 180° in the circumferential direction of the tubular portion 11 in the above embodiment, an angle between the bracket holding portions may be arbitrary changed. The bracket holding portions may be provided at equal angular intervals in the circumferential direction as the number of the bracket holding portions is changed as described above.

Although the lower end surfaces 21*a*, 22*a* of the first and second bracket holding portions 21, 22 are flush each other in the above embodiment, there is no limitation to this. Extending lengths of the first and second bracket holding portions 21, 22 may be changed to make the positions of the lower end surfaces 21*a*, 22*a* different.

Although the first bracket holding portion 21 is provided at the position overlapping with the tubular portion 11 in the vertical direction and the second bracket holding portion 22 is provided at the position not overlapping with the tubular portion 11 in the vertical direction (position deviated from the tubular portion 11) in the above embodiment, there is no limitation to this. For example, the both first and second bracket holding portions 21, 22 may be provided at positions not overlapping with the tubular portion 11 in the vertical direction (positions deviated from the tubular portion 11) or the both first and second bracket holding portions 21, 22 may be provided at positions overlapping with the tubular portion 11 in the vertical direction.

Although the harness holding portion 40 is integrally provided to the second bracket holding portion 22 in the above embodiment, the harness holding portion may be provided at another position.

The above embodiment and the respective modifications may be combined as appropriate.

LIST OF REFERENCE SIGNS

1 . . . electrical component
10 . . . connector
11 . . . tubular portion
12 . . . connector pin portion (connecting portion)
21 . . . first bracket holding portion (engaging portion)
21*a* . . . lower end surface
22 . . . second bracket holding portion (engaging portion)
22*a* . . . lower end surface
23 . . . first insertion groove (insertion groove)
24 . . . second insertion groove (insertion groove)
30 . . . bracket (supporting member)
40 . . . harness holding portion
R . . . case (mating member)

What is claimed is:

1. A connector to be loosely movably supported by first and second mounting pieces of a supporting member, comprising:

a connecting portion to be electrically connected to a mating member;

a tubular portion having opposite front and rear ends, the front end being disposed to face the mating member, the tubular porting accommodating the connecting portion so that the connecting portion faces the mating member when the front end of the tubular portion faces the mating member; and first and second engaging portions extending from diametrically opposite positions at the rear end of the tubular portion and configured to be engaged respectively with the first and second mounting pieces of the supporting member in a state where loose movements are allowed;

each of the first and second engaging portions including an insertion groove through which the respective first and second mounting pieces of the supporting member are insertable, the first engaging portion being aligned axially with the tubular portion being at a position deviated radially from the tubular portion.

2. The connector of claim 1, wherein rear surfaces of the first and second engaging portions at the rear end of the tubular portion are flush with each other.

3. The connector of claim 1, further comprising a harness holding portion integral with the second engaging portion and configured for holding a harness.

4. The connector of claim 1, wherein:

each of the first and second engaging portions includes an insertion groove through which the mounting pieces of the supporting member are insertable.

5. The connector of claim 1, wherein the harness holding portion has a rear surface that is substantially flush with rear surfaces of the first and second engaging portions at the rear end of the tubular portion.

* * * * *